US005337029A

United States Patent [19]

Nobutoki et al.

[11] Patent Number: 5,337,029

[45] Date of Patent: Aug. 9, 1994

[54] POLARIZED RELAY

[75] Inventors: Kazuhiro Nobutoki; Kyoji Ueda, both of Matsusaka; Hiroyuki Kita, Tamaki, all of Japan

[73] Assignee: Matsushita Electric Works, Ltd., Osaka, Japan

[21] Appl. No.: 995,007

[22] Filed: Dec. 22, 1992

[30] Foreign Application Priority Data

Dec. 24, 1991 [JP] Japan ..... 3-340486
Apr. 23, 1992 [JP] Japan ..... 4-103379
Jun. 25, 1992 [JP] Japan ..... 4-166609

[51] Int. Cl.[5] ..... H01H 50/00
[52] U.S. Cl. ..... 335/78; 335/83
[58] Field of Search ..... 335/78-86, 335/124, 128, 202

[56] References Cited

U.S. PATENT DOCUMENTS 4,499,442 2/1985 Kamo et al. .
4,695,813 9/1987 Nobutoki et al. .
4,703,293 10/1987 Ono et al. .

FOREIGN PATENT DOCUMENTS 0481371 4/1992 European Pat. Off. .
4192236 7/1992 Japan .

*Primary Examiner*—Lincoln Donovan

*Attorney, Agent, or Firm*—Stevens, Davis, Miller & Mosher

[57] ABSTRACT

A polarized relay includes a coil block having an elongated coil bobbin, a core inserted therein, and an excitation coil wound about the coil bobbin. The core has opposed pole ends projecting upwardly from longitudinal ends of the coil bobbin. A permanent magnet is interposed between the pole ends on the coil bobbin. Disposed on the coil block is an armature block which comprises an elongated generally flat armature and a set of movable springs carrying movable contacts. The movable springs are held together with the armature by means of an electrically insulating harness molded on the armature. The armature is pivotally supported on the coil block to be movable between two contact operating positions and constituting a magnetic circuit with the core and the permanent magnet for polarized operation of the armature. A terminal assembly is provided to include coil terminals leading to the excitation coil and fixed contact terminals provided respectively with fixed contacts at contact ends of the contact terminals. The polarized relay is characterized in that the coil block and the terminal assembly are molded together from an electrically insulating material into a single integral base unit on which the armature block is assembled with the movable contacts held in an engageable relation with the fixed contacts.

16 Claims, 9 Drawing Sheets 12
31
45
44
60
62
53
55
51
4
5
50
57
47
46
43
41
10
22
21
30
25
35
32

13
12

50
47
35
44
45
10
41
43
46
43
41

POLARIZED RELAY

BACKGROUND OF THE INVENTION

1. Field of the Invention

The present invention is directed to a polarized relay, and more particularly to a polarized relay having an armature pivotally supported at its center to be swingable between two contact operating positions.

2. Description of the Prior Art

Polarized relays having a swingable armature are well known in the art, for example, as disclosed in U.S. Pat. Nos. 4,695,813, 4,703,293, and 4,499,442. Such prior art polarized relay comprises a coil block and an armature block which are fabricated as separate units and assembled together into a housing provided with a set of contacts and contact terminals extending therefrom. The coil block includes a coil bobbin having an excitation coil wound therearound, a core inserted therethrough, and coil leads extending from the ends of the excitation coil. A permanent magnet is disposed between the opposed legs of the core projecting on the ends of the coil bobbin. The armature assembly includes an armature and a set of movable springs with movable contacts which are held together and movable with the armature. The armature is pivotally supported on the casing so as to movable between two contacting operating positions of closing and opening the movable contacts with respect to the corresponding contacts on the side of the casing. Since such prior polarized relay requires to assemble the separately fabricated coil block and the armature block into the casing, a special care should be taken in order to place the coil block and the permanent magnet into an exact position in relation to the armature block in order to assure a predetermined magnetic gap between the core of the coil block and the armature of the armature block. Also, another care should be taken to isolate the movable springs from the coil by a distance sufficiently for effective electrical insulation therebetween. The above problems will be more prominent when the relay is to be miniaturized.

SUMMARY OF THE INVENTION

The above problems have been eliminated in the present invention which provides an improved polarized relay. The polarized relay in accordance with the present invention comprises a coil block having an elongated coil bobbin, a core inserted therein, and an excitation coil wound about the coil bobbin. The core has opposed pole ends projecting upwardly from longitudinal ends of the coil bobbin. A permanent magnet is interposed between the pole ends on the coil bobbin. Disposed on the coil block is an armature block which comprises an elongated generally flat armature and a set of movable springs carrying movable contacts. The movable springs are held together with the armature by means of an electrically insulating harness molded on the armature. The armature is pivotally supported on the coil block to be movable between two contact operating positions and constituting a magnetic circuit with the core and the permanent magnet for polarized operation of the armature. A terminal assembly is provided to include coil terminals leading to the excitation coil and fixed contact terminals provided respectively with fixed contacts at contact ends of the contact terminals. The characterizing feature of the polarized relay resides in that the coil block and the terminal assembly are molded together from an electrically insulating material into a single integral base unit on which the armature block is assembled with the movable contacts held in an engageable relation with the fixed contacts. Accordingly, it is readily possible to fix the coil block, the permanent magnet, and the contact terminals in accurate positions within the resulting base unit on which the armature block is mounted. Whereby it is assured that the coil block, the fixed contacts of the contact terminals and the armature block can be held in an exact mutual spatial relation to each other, which gives rise to exact magnetic gap between the core of the coil block and the armature. In addition, the coil block can be embedded within the base unit of the electrically insulating material, the coil is well electrically isolated from the movable contacts on the side of the armature. These features assures enhanced reliable operation characteristics, particularly for miniaturized relays.

Accordingly, it is a primary object of the present invention to provide an improved polarized relay which is assured of reliable operation characteristics as well as of superior electrical insulation for high voltage use.

In a preferred embodiment, the coil bobbin is formed integrally on its upper end with supports upon which the contact ends of the fixed contact terminals rest, respectively. The supports are adapted to hold the contact ends against an upper molding die when molding said coil block into the base unit between the upper molding die and a lower molding die in order to retain the fixed contacts in place. Thus, the fixed contacts can be positioned accurately on the base unit and therefore can be held in exact registration with the movable contacts on the side of the armature block, which is therefore another object of the present invention.

Additionally, the coil bobbin is formed integrally on its lower end with collapsible bumps which are adapted to abut against the lower molding die when molding the coil block into the base unit in order to urge the supports upwardly for pressing said contact ends against said upper molding die. The collapsible bumps can compensate for possible shortage of dimension of the coil bobbin between the upper and lower dies, thereby assuring positive pressing engagement of the contacts ends against the upper molding die by means of the supports and therefore exact positioning of the fixed contacts on the resulting base unit. It is therefore a further object of the present invention to provide an improved polarized relay in which the fixed contacts are exactly positioned on the base unit.

The coil terminals are formed with patches which are welded to corresponding leads integrally molded in the coil bobbin at portions spaced generally vertically below associated ones of the fixed contacts. Thus, the connection of the coil terminal with the excitation coil can be spaced enough distance from the adjacent fixed contact within the length of the coil bobbin, thereby providing good electrical insulation between the coil terminals and the fixed contacts, yet without requiring additional length dimension to the relay.

It is therefore a still further object of the present invention to provide an improved polarized relay which is capable of presenting sufficient electrical insulation between the coil terminals and the adjacent fixed contacts within a limited lengthwise dimension of the relay.

The coil assembly is in the form of a blank from which the coil terminals and fixed contact terminals are stamped to extend in adjacent relation. In order to afford the vertical distance between the coil terminal and the fixed contact terminal in assembling the coil block into the base unit, each of the coil terminals is spaced vertically downwardly of the adjacent one of the fixed contacts and connected integrally thereto by means of a bent segment at which the coil terminal is to be separated from the fixed contact terminal.

In a preferred embodiment, the armature block is provided with hinge springs disposed on the lateral sides of the armature, respectively at a longitudinal center thereof for mounting said armature block on the base unit. Each of the hinge springs is integrally formed with a beam projecting from the harness and with an anchor tab extending integrally from the beam and secured to a corresponding portion of the base unit. The harness is formed integrally with a side post which projects on the lateral side of said armature and from which said beam extends over a limited length along the lateral side of said armature. With this structure of extending the beam in a lengthwise direction of the armature, the beam or the hinge spring can be given sufficient resiliency in a direction perpendicular to a general plane of the armature such that the beam can well absorb external shocks which would otherwise distort the hinge spring. In other words, the beam can have an extended length within the length of the armature for giving enough resiliency to the hinge spring without requiring the hinge springs to have an extra dimension in the width dimension, such that the overall width dimension can be kept at a minimum. It is therefore a more object of the present invention to provide an improved polarized relay which is capable of well absorbing external shocks at the hinge springs to assure a reliable armature movement, yet requiring no additional width dimension to the relay.

Preferably, the side post from which the beam extends is offset toward one longitudinal end of said armature from a longitudinal center thereof at which said armature is pivotally supported, while the anchor tab is kept at the longitudinal center of the armature. With this structure of spacing the root end of the beam from the longitudinal center or pivot center of the armature, it is readily to resiliently flex the beam at the time of mounting the armature block on the base unit, thereby obtaining a suitable bias to the hinge spring in a direction of urging the armature in one of the two contacting positions. Therefore, the armature can be easily made to have a monostable operation. The above bias of the hinge spring may be added to a magnetic bias of the magnetic circuit of the core, the permanent magnet, and the armature to ensure the mono-stable armature operation, particularly when the magnetic circuit is limited to have insufficient bias to the armature, which is therefore a still more object of the present invention.

The beam and the anchor tab lies substantially in the same plane and are integrally connected by means of U-shaped segment which is bent in a direction perpendicular to said plane. With the inclusion of the vertically bent U-shaped segment in the hinge spring, the beam is allowed to have limited movement in substantially all directions relative to the anchor tab secured to the base unit. Thus, the hinge spring can successfully absorb any external shocks in all directions to thereby protect the armature therefrom and assure reliable relay operation, which is therefore a more object of the present invention.

The beam may be formed along its length with a bent which increases an effective length of the beam such that the beam is permitted to resiliently move vertically relative to the anchor tab for giving increased shock absorbing to the hinge assembly in the vertically direction, which is therefore a still more object of the present invention.

These and still other objects and advantageous features of the present invention will become more apparent from the detailed description of the embodiment when taken in conjunction with the attached drawings.

DETAILED DESCRIPTION OF THE EMBODIMENT

Figure 1:
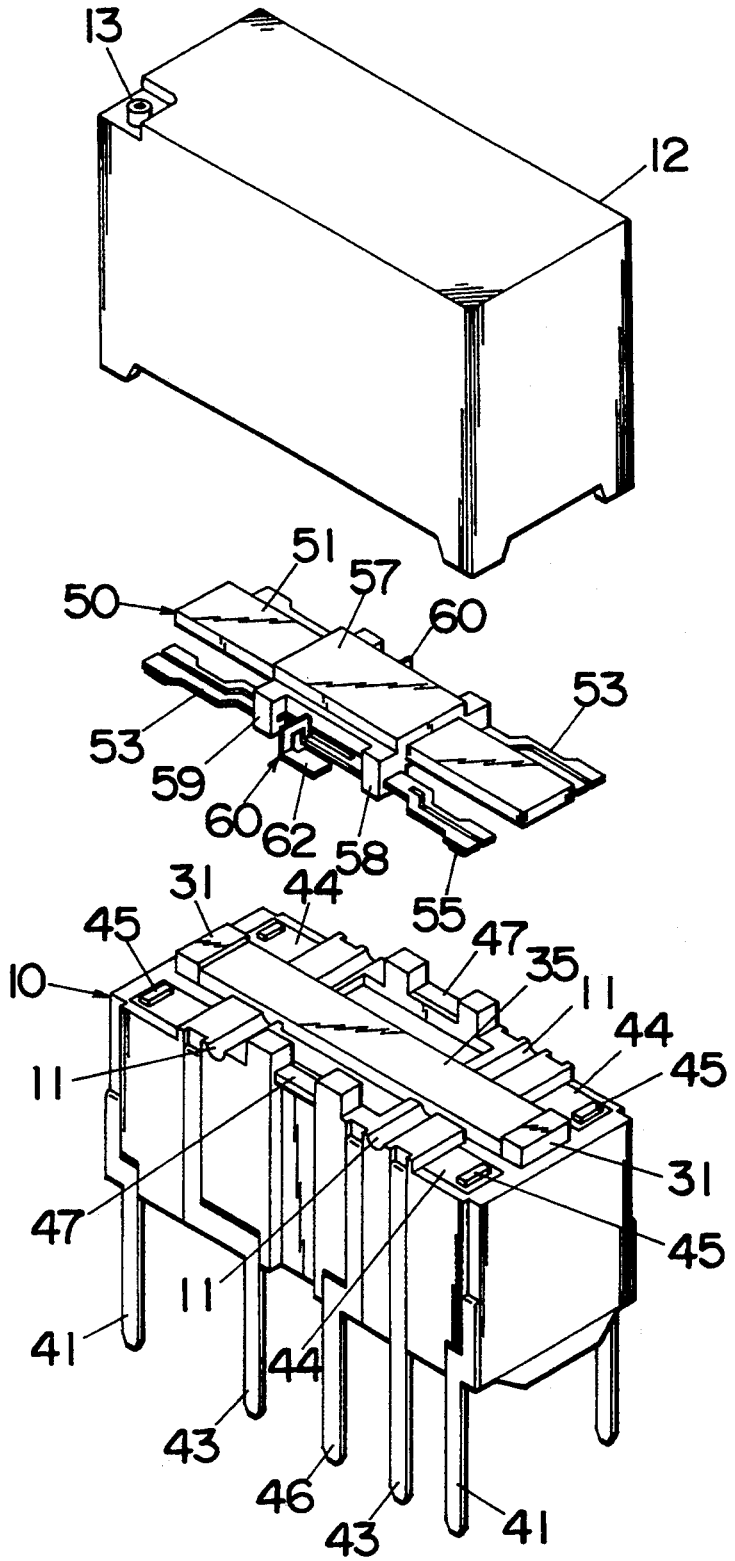
FIG. 1 is an exploded perspective view of a polarized relay in accordance with a preferred embodiment of the present invention.
Figures 2, 3, 4, 5:
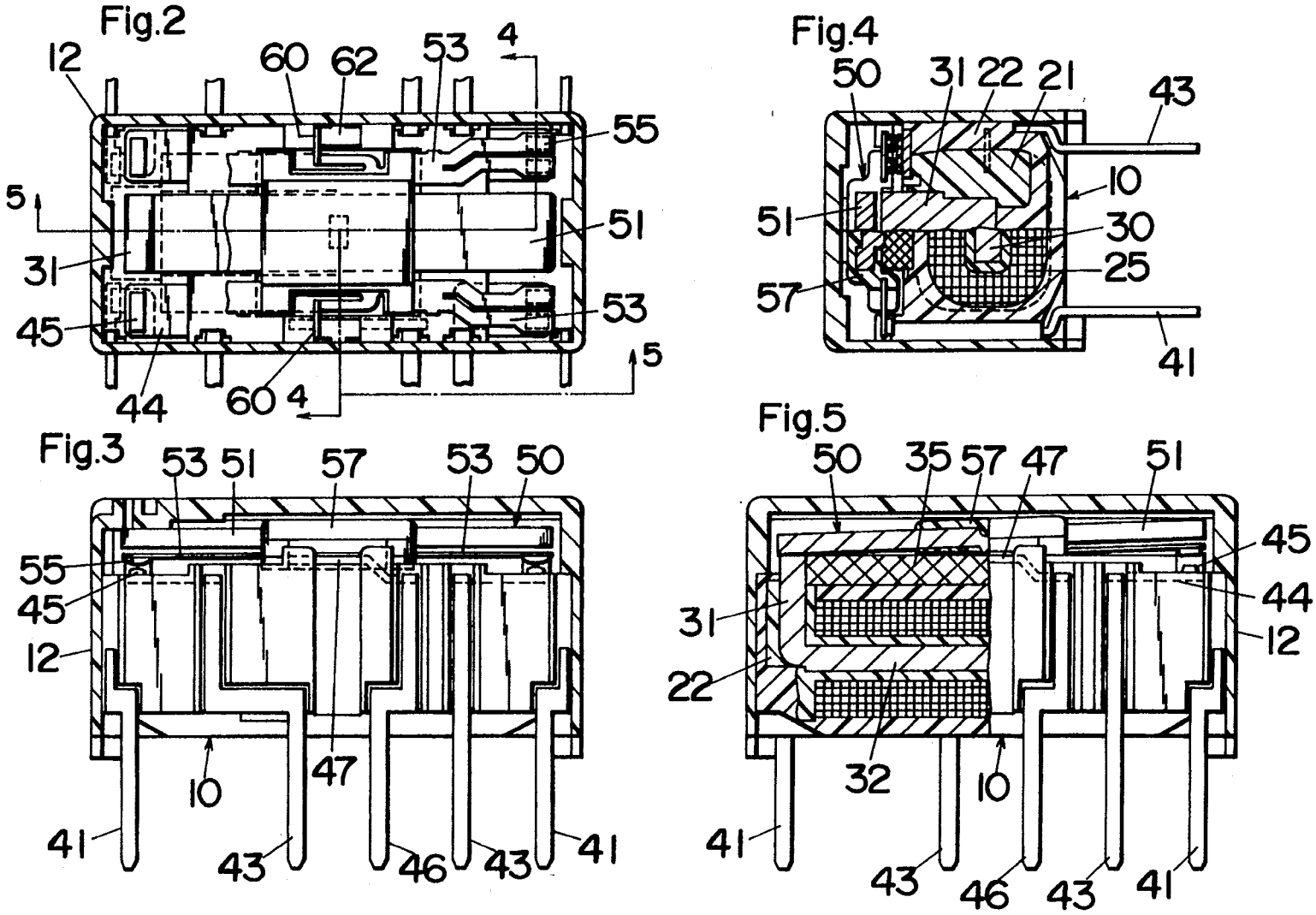
FIG. 2 is a top view, partly in section, of the above relay.
FIG. 3 is front view, partly in section, of the above relay.
FIG. 4 is a sectional view taken along line 4—4 of FIG. 2.
FIG. 5 is a sectional view taken along line 5—5 of FIG. 2.
Figure 6:
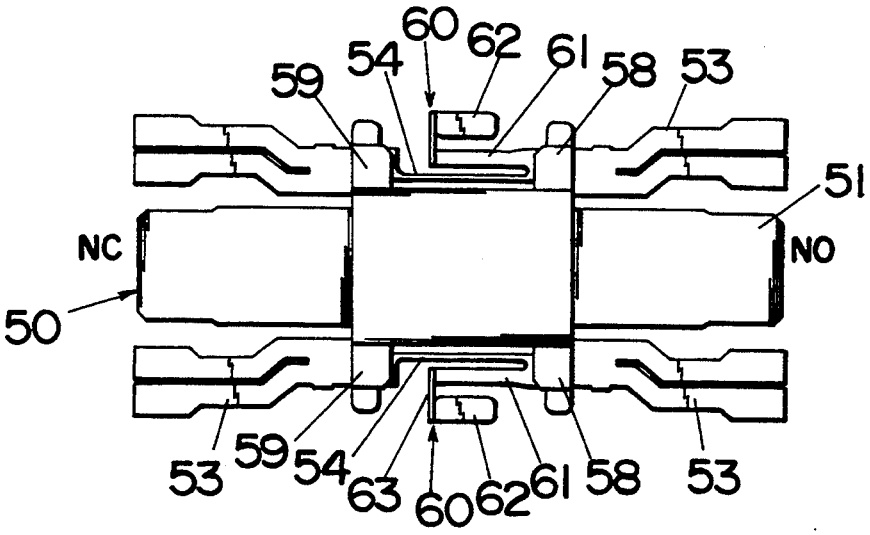
FIG. 6 is a top view of an armature block consisting the above relay.

Referring now to FIGS. 1 to 5, there is shown a polarized relay in accordance with a preferred embodiment of the present invention. The polarized relay is of monostable operation and of double-pole double-throw contact arrangement. The relay comprises a base unit 10 which is molded from an electrically insulating plastic material into a rectangular solid with a coil block 20 embedded therein together with corresponding coil terminals 41 and fixed contact terminals 43. Mounted on the base unit 10 is an armature block 50 which comprises an elongated flat armature 51 and a set of movable springs 52 extending on the lateral sides thereof in such a manner that the two movable sprigs are longitudinally aligned on either side of the armature. The two longitudinally aligned movable springs 53 are stamped out from a single copper sheet (not shown) to be connected by a center bridge 54 and are provided respectively at its free ends with contact tips 55. The movable springs 53 are held together with the armature 51 by means of a harness 57 which is molded from an electrically insulating plastic material on the middle of the armature 51. The harness 57 is formed on either side of the armature 51 with a pair of side posts 58 and 59 through which the two longitudinally aligned movable springs 53 extend in spaced relation to the lateral side of the armature with the center bridge 53 disposed between the longitudinally spaced side posts 58 and 59, as best shown in FIG. 6. Integrally extending from the center bridges 53 are hinge springs 60 by which the armature block 50 is pivotally supported on the base unit 10 so that the armature 51 is swingable between two contact operating positions. The details of the hinge springs 60 will be discussed later.

Figure 7:
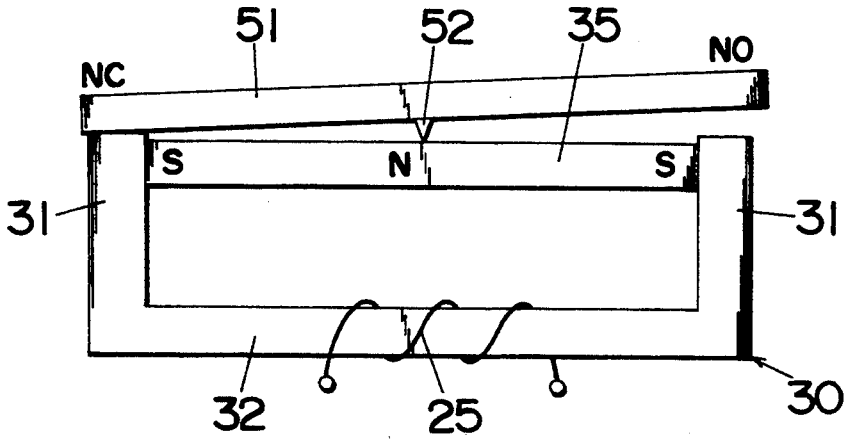
FIG. 7 is a schematic view of a magnetic circuit of the above relay.

The coil block 20 comprises an elongated coil bobbin 21 molded from an electrically insulating plastic to have end flanges 22 at the longitudinal ends thereof. Coupled to the coil bobbin 21 is a generally U-shaped core 30 with a pair of opposed legs 21 bridged by an elongated web 22 which is inserted into the coil bobbin in such a manner as to project the upper ends of the legs 21 on the upper ends of the flange 22, respectively. The projecting portions of the legs 31 define there at opposed pole ends which comes into registration with the longitudinal ends of the armature 51. Interposed between the opposed pole ends of the core 30 is a bar-shaped three-pole permanent magnet 35 which is magnetized to have end poles of the same polarity, for example, south poles S at the longitudinal ends and to have a center pole, i.e., north pole N of the opposite polarity to the end poles. The permanent magnet 35 is held on the coil block 20 with its end poles attached to the pole ends, or the legs 31 of the core 30 in a spaced relation with the excitation coil 25. The armature 51 extends along the permanent magnet 35 and is cooperative with the magnet 35 and the core 30 to form a magnetic circuit, as schematically shown in FIG. 7. That is, the armature 51 is magnetically coupled to the core 30 with a center projection 51 in constant engagement with the center of the permanent magnet 35 and with the longitudinal ends in open and close relation with the pole ends 31 of the core 30. The center of the armature 50 corresponds to a pivot axis about which the armature block is supported on the base unit 10 by means of the hinge springs 60. It is noted at this point that the center pole N is offset from the pivot axis toward one end of the permanent magnet 35 in order to magnetically bias the armature 51 toward one of the two contact operating positions. That is, the armature 51 is stable at the one contacting position, which is referred to as normally closed (NC) position of engaging the movable contacts 55 at one end of the armature 51 to corresponding fixed contacts 45 at one ends of the fixed contact terminals 43 upon deenergization of the excitation coil 25. In this sense, the one longitudinal end of the armature 51 is defined as a NC end and the other as a NO end, as indicated in FIG. 7. Upon energization of the excitation coil 15 by a current of selective polarity, the armature 51 or the armature block 50 is pivoted to have its NO end attracted to the corresponding pole end 31 of the core 30 for engaging the movable contacts 55 at this end with corresponding fixed contacts 45.

Figure 12:
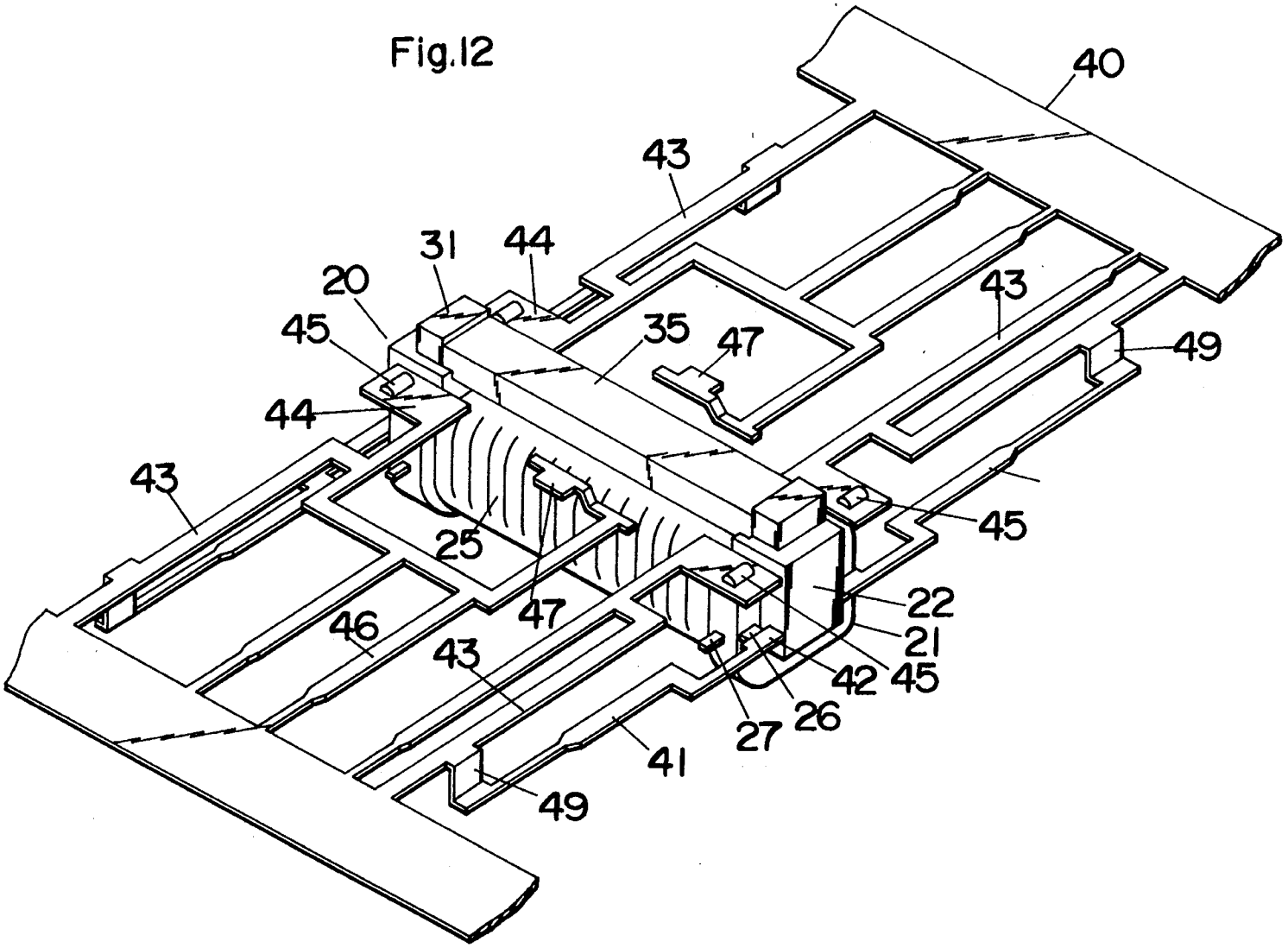
FIG. 12 is an enlarged perspective view of the coil bloc with the terminal assembly bonded thereto.

The coil terminals 41 and the fixed contact terminals 43 are formed together with common contact terminals 46 in a terminal assembly which is in the form of a blank stamped from a single electrically conductive material, as shown in FIG. 12. These terminals 41, 43, and 46 are commonly supported by a frame 48 to extend inwardly thereof in such a manner as to provide on either side of the coil block 20 one terminal set which includes a pair of the coil terminals 41, a pair of the fixed contact terminals 43, and the common contact terminal 46. The coil terminal 41 is formed at its free end with a patch 42 for connection with a coil lead 26 which is partially molded into the flange 22 of the coil bobbin 20 and is connected to the end of the excitation coil 25 through a lug 27 also extending from the flange 22 and integrally joining the coil lead 26 within the flange 22. The fixed contact terminal 43 which extends inwardly of the coil terminal 41 is formed at its free end adjacent to the patch 42 with a tab 44 having thereon the fixed contact 45. The common contact terminal 46 extends inwardly of the fixed contact terminal 43 and is formed at its free end with a land 47 which is to be connected to the movable spring 53 on the side of the armature block 50 by way of the hinge spring 60.

Figure 9:
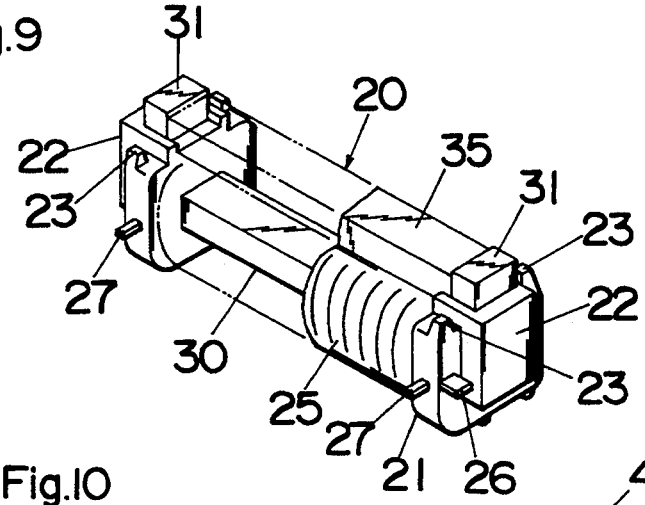
FIG. 9 is a perspective view of a coil block constituting the above relay.
Figure 10:
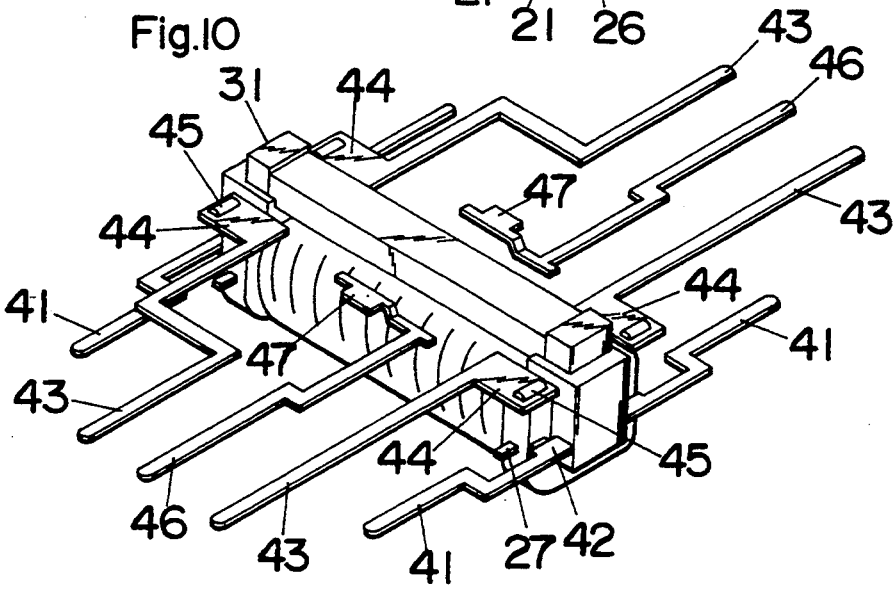
FIG. 10 is a perspective view of the coil block with a terminal assembly bonded thereto prior to being molded into a base unit of the above relay.
Figure 11:
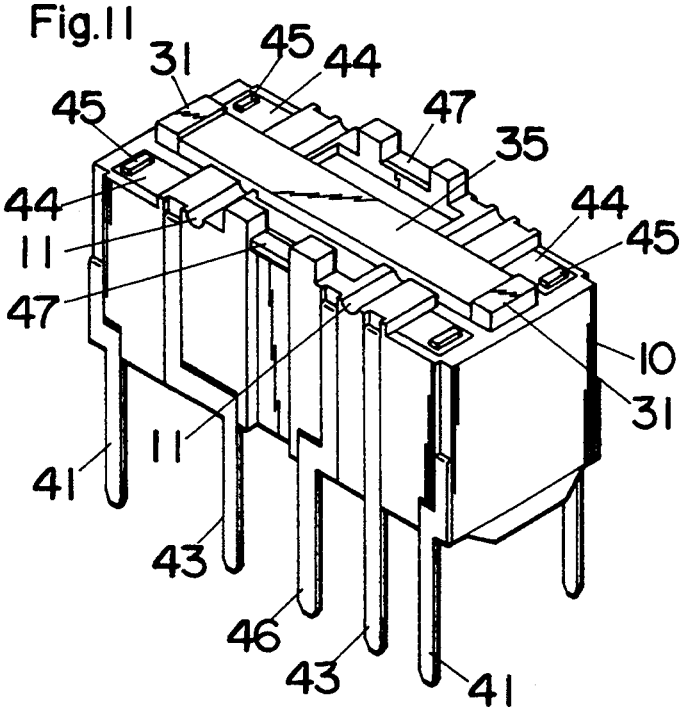
FIG. 11 is a perspective view of the base unit of the relay having the coil block embedded therein.
Figure 13A:
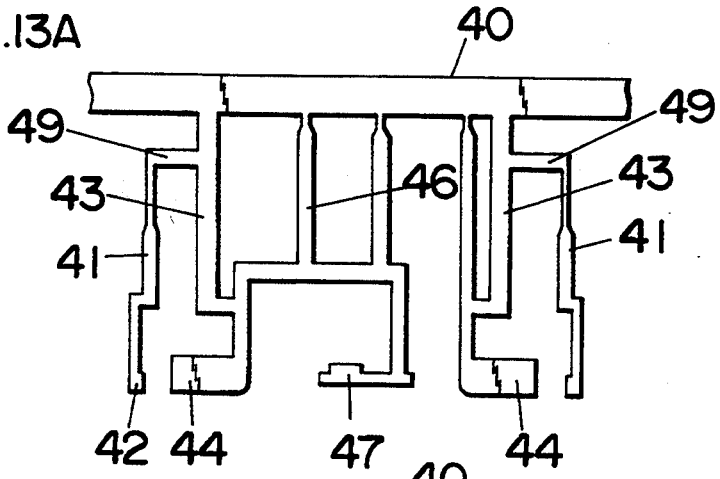
FIGS. 13A and 13B are partial plan views of the terminal assembly with coil terminals shown in pre-bent and post-bent conditions.
Figure 13B:
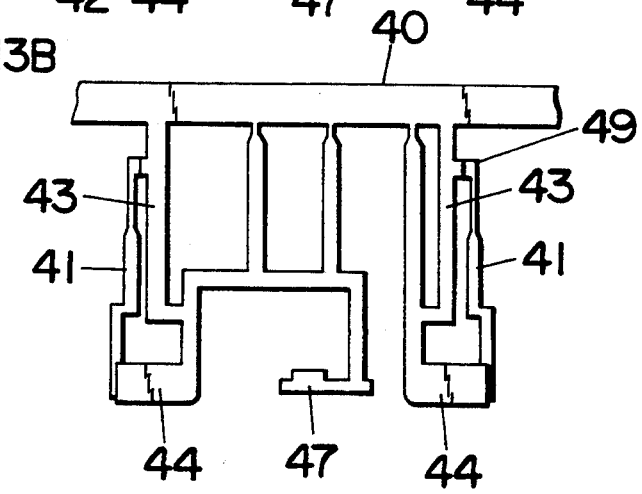
Figure 14:
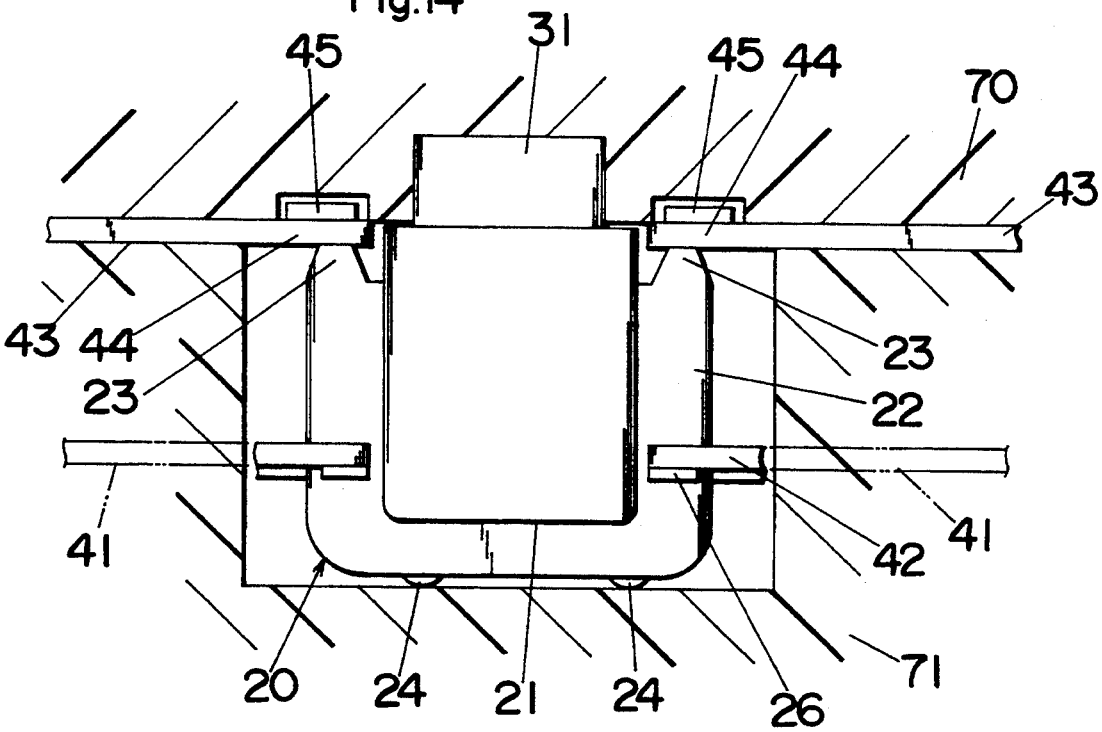
FIG. 14 is a schematic view illustrating the coil block held between upper and lower molding dies prior to being molded into the base unit.

Thus formed terminal assembly 40 is held to the coil assembly 20 with the patches 42 welded to the coil leads 26 and is molded together with the coil block 20 between an upper die 70 and a lower die 71, as shown in FIG. 14, to provide the base unit 10, in such a manner as to expose the fixed contacts 45, the land 47, the upper ends of the pole ends or legs 31 of the core 30, and the permanent magnet 35. Thereafter, the individual terminals are separated from the blank frame 48 and also from each other followed by being bent downwardly along the sides of the base unit 10, as shown in FIG. 11. It should be noted at this point that the coil bobbin 21 is formed on its flanges 22 adjacent the pole ends 31 with support studs 23, as best shown in FIG. 9, for supporting thereon the corresponding tabs 44 carrying the fixed contacts 45 at the time of molding. The studs 23 are adapted to urge the tabs 44 against the wall of the upper die 70, as shown in FIG. 14, to keep the tabs 44 and therefore the fixed contacts 45 at an exact position during the molding, thereby assuring accurate positioning of the fixed contacts 45 on the base unit 10 and therefore assuring exact registration with movable contacts 55 of the armature block 50 on the base unit 10. In order to successfully pressing the tabs 44 against the upper molding die 70 even if the flanges 22 should have a height shorter than a predetermined dimension, the flanges 22 are formed on their bottoms with collapsible bumps 22 which are in constant pressing engagement with lower molding die 71, also as shown in FIG. 14. With the provision of the collapsible bumps 22, the studs 23 are always urged upwardly to thereby press the tabs 44 against the upper molding die 70 for accurate positioning of the fixed contacts. It is noted in this connection that the permanent magnet 35 can be well isolated from the excitation coil 25 by the plastic material filled at the molding between the magnet 35 and the coil 25. Also, the tabs 44 of the coil terminals 43 are embedded within the base unit 10 so as to be well isolated from the adjacent fixed contacts 45. Further, the tab 44 is located vertically downwardly of the adjacent fixed contact 45 or the tab 44 to be spaced therefrom by an extended distance in the vertical direction. Therefore, enough electrical isolation is also obtained within the height of the coil block without requiring additional lengthwise insulating distance to the coil block 20. To this end, after stamped into the blank of FIG. 13A, the terminal assembly 40 is processed to bend bridge segments 49 connecting the coil terminals 41 and the adjacent fixed contact terminals 43 adjacent the frame 48 such that the coil terminals 41 extends in downwardly spaced parallel relation to the adjacent fixed contact terminals 43, as shown in FIG. 13A and FIG. 12, to have the patch 42 of the coil terminal 41 overlapped with the tab 44 of the fixed contact terminal 43. After molding the terminal assembly 40 partly within the base unit 10, the fixed contact terminals 43 are separated from the adjacent coil terminals 41 at the bent segments 49.

Figure 8:
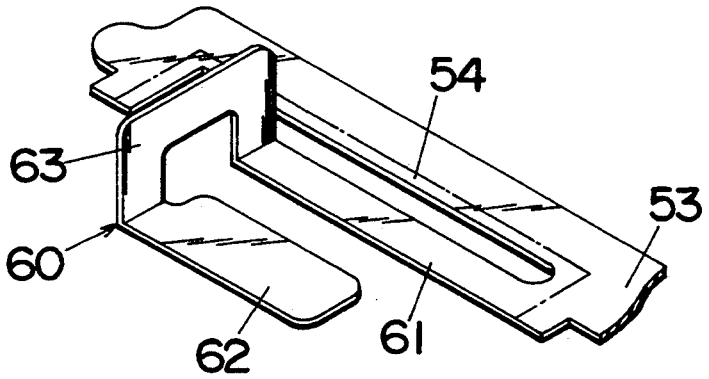
FIG. 8 is a perspective view of a hinge spring on the lateral side of the armature block.

The hinge springs 60 by which the armature block 50 is pivotally supported on the base unit 10 are specifically designed to absorb external shocks or forces applied to the relay for assuring reliable and stable contact operations during an extended use. The hinge spring 60 is formed integrally with the corresponding movable spring 53 to comprise a beam 61 extending in spaced parallel relation to the center bridge 54 of the movable spring 53, an anchor tab 62, and a U-shaped segment 63 integrally connecting the beam 61 and the anchor tab 62, as shown in FIGS. 6 and 8. It is this anchor tab 62 that is welded to the land 47 on the longitudinal center of the base unit 10 to mount the armature block 50 on the base unit 10. The beam 61 extends from the side post 58 longitudinally offset from the pivot axis toward the NC end of the armature 61 with the connection of the beam 61 and the center bridge 54 of the movable spring 53 molded into the side post 58 and also with the major portion of the center bridge 54 molded into the harness 57. The molded-in area is shown in FIG. 8 as being located inwardly of a dotted boundary line. By offsetting the root end of the beam 61 from the pivot axis or center of the armature block 50, the beam 61 can be resiliently deformed when assembling the armature block 50 on the base unit 10 such that the beam 61 produces a spring bias of urging the armature block 50 toward the normally open contacting position. Such spring bias is additive to the magnetic bias of the magnetic circuit to give a monostable armature operation. It is noted in this connection, the spring bias of the beam can alone make the mono-stable operation of the armature block when the magnetic circuit is configured to exert no magnetic bias. Further, due to the resilient deformability of the beam 61 relative to the anchor tab 62 in the vertical direction, the beam 61 can well absorb external shocks or forces applied in that direction, i.e., in the direction of z in FIG. 8. The U-shaped segment 63 connecting the beam 61 and the anchor tab 62 is bent vertically upwardly such that the beam 61 is allowed to resiliently flex relative to the anchor tab 62 by a sufficient amount horizontally, i.e., in the directions of x and y in the figure. Whereby, the hinge spring 60 can absorb external forces acting in all directions.

Figure 15:
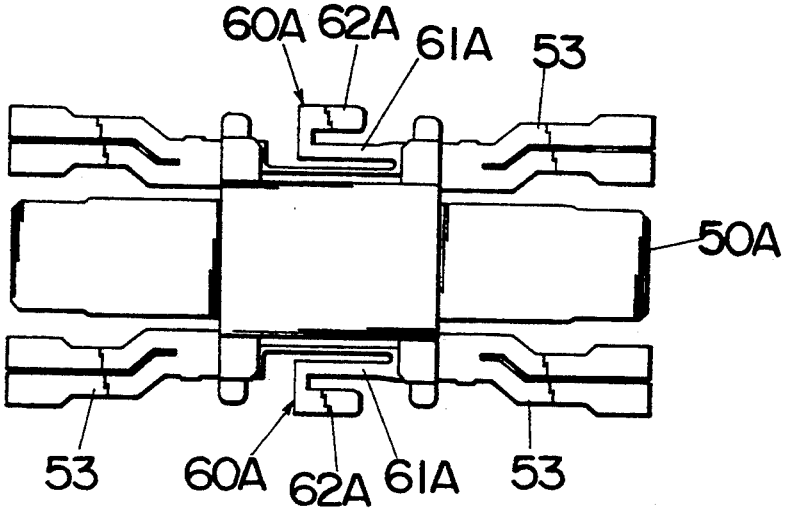
FIG. 15 is a top view of a modified armature block which may be utilized instead in the above relay.
Figure 16:
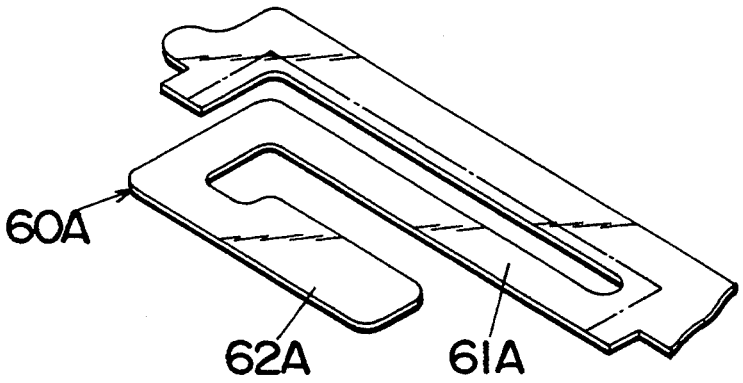
FIG. 16 is a perspective view of a hinge spring of the armature block of FIG. 15.
Figure 17:
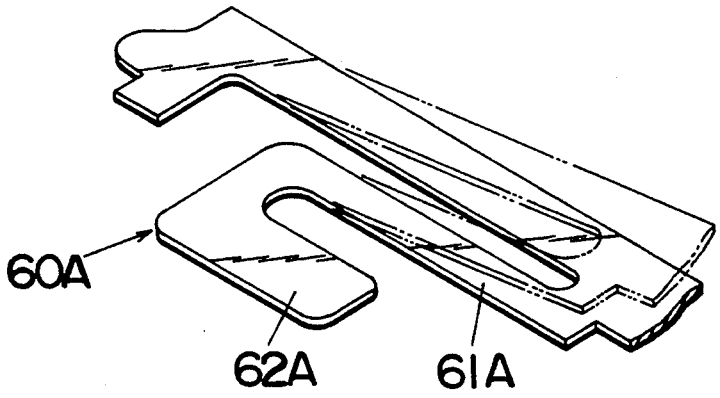
FIG. 17 is a perspective view illustrating expected resilient deformation of the hinge spring.
Figure 18:
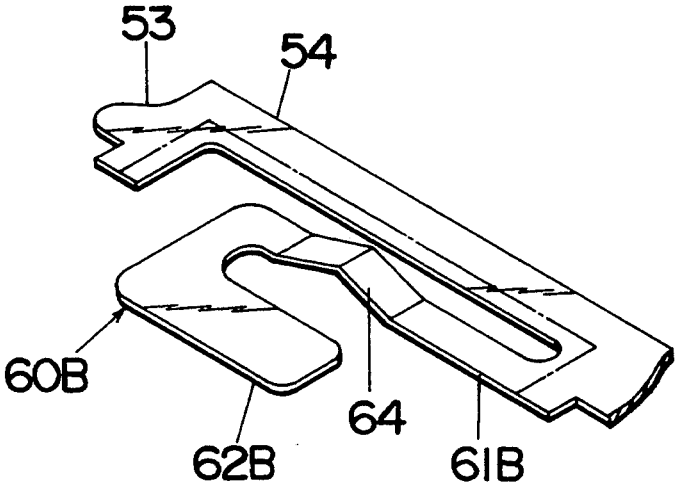
FIG. 18 is a perspective view illustrating another modified hinge spring of the armature block.

FIG. 15 illustrates a modified armature block 50A which is identical to the armature block 50 of the above embodiment except that hinge springs 60A dispense with the vertically bent U-shaped segment 63. Rather the hinge spring 60A comprises a like beam 61A and a like anchor tab 62 extending in substantially the same plane and integrally connected to form a generally U-shaped horizontal configuration. With this structure, the beam 61A can be allowed to resiliently flex vertically relative to the anchor tab 62A, i.e, the base unit 10, as shown in FIG. 17 such that the hinge spring 60A can absorb external shocks applied in the vertical direction. In order to elongate the effective length of the beam for increased shock absorption capability, another modification hinge spring 60B is presented, as shown in FIG. 18, in which a like beam 61B is shaped to have a bent 64 intermediate its ends. In this modification, the beam 61B is also permitted to resiliently deform in the direction of flattening the bent 64 or in the lengthwise direction of the beam 61B relative to the anchor tab 62B, thereby enabling to absorb external shocks also in that direction.

After assembling the armature block 50 on the base unit 10, a fine adjustment, if necessary, is made to place the movable contacts 55 in exact position relative to the associated fixed contacts 45 by slightly deforming the movable sprigs 53. For this purpose, the base unit 10 is formed in its upper surface with concavities 11 which permit the access of a tool for adjusting the movable springs 53. A cover 12 is fitted over the base unit 10 to enclose the armature block 50 in a sealed manner by the use of a sealant filled in the engaging portion between the cover 12 and the base unit 10. The cover 12 is provided with a vent 13 for evacuation of gas which is generated when heating the sealant to effect the sealing. After establishing the sealing, the vent 13 is closed by a suitable material.

Figure 19:
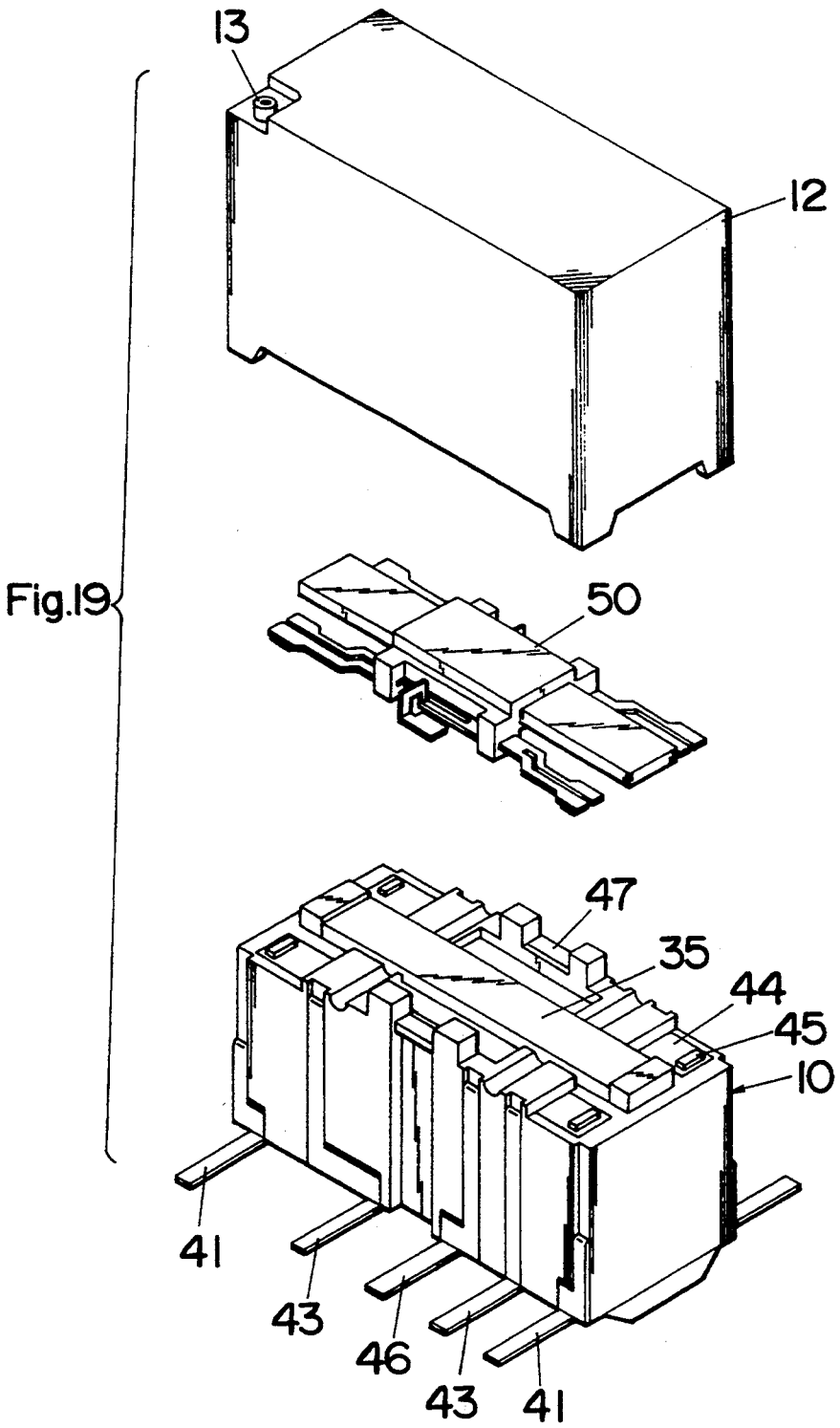
FIG. 19 is a perspective view of a modified polarized relay.

FIG. 19 illustrates a modification of the above relay in which the lower ends of the terminals are bent horizontally for surface mounting arrangement. The other structures are identical to those of the above embodiment.

What is claimed is:

1. A polarized relay comprising:

a coil block having an elongated coil bobbin, a core inserted therein, and excitation coil means wound about said coil bobbin, said core having opposed pole ends projecting upwardly from longitudinal ends of said coil bobbin, said coil block including a permanent magnet interposed between said pole ends;

an armature block having an elongated generally flat armature and a set of movable springs carrying movable contacts and held together with said armature by means of an electrically insulating harness molded on said armature, said armature pivotally supported on said coil block to be movable between two contact operating positions and constituting a magnetic circuit with said core and said permanent magnet for polarized operation of said armature; and a terminal assembly including coil terminals leading to said coil means and fixed contact terminals provided respectively with fixed contacts at contact ends of said contact terminals;

said polarized relay characterized in that said coil block and said terminal assembly are molded together from an electrically insulating material into a single integral base unit on which said armature block is assembled with said movable contacts held in an engageable relation with said fixed contacts;

wherein said coil bobbin is formed integrally on its upper end with supports upon which said contact ends of said fixed contact terminals rest, respectively, said supports adapted to hold said contact ends against an upper molding die when molding said coil block into said base unit between said upper molding die and a lower molding die in order to retain said fixed contacts in place.

2. A polarized relay as set forth in claim 1, wherein said supports are in the form of integral projections on said coil bobbin.

3. A polarized relay as set forth in claim 1, wherein said coil bobbin is formed integrally on its lower end with collapsible bumps which are adapted to abut against said lower molding die when molding said coil block into said base unit in order to urge said supports upwardly for pressing said contact ends against said upper molding die.

4. A polarized relay as set forth in claim 1, wherein said coil terminals are formed with patches which are welded to corresponding leads integrally molded in said coil bobbin at portions spaced generally vertically below associated ones of said fixed contacts.

5. A polarized relay as set forth in claim 4, wherein said coil assembly is in the form of a blank from which said coil terminals and fixed contact terminals are stamped to extend in adjacent relation, each of said coil terminals spaced vertically downwardly of the adjacent one of said fixed contacts and connected integrally thereto by means of a bent segment at which said coil terminal is to be separated from said fixed contact terminal.

6. A polarized relay as set forth in claim 1, wherein said armature block is provided with hinge springs disposed on the lateral sides of said armature, respectively at a longitudinal center thereof for mounting said armature block on said base unit, said hinge spring integrally formed with a beam projecting from said harness and with an anchor tab extending integrally from said beam and secured to a corresponding portion of said base unit, said harness formed integrally with a side post which projects on the lateral side of said armature and from which said beam extends over a limited length along the lateral side of said armature.

7. A polarized relay comprising:

a coil block having an elongated coil bobbin, a core inserted therein, and excitation coil means wound about said coil bobbin, said core having opposed pole ends projecting upwardly from longitudinal ends of said coil bobbin, said coil block including a permanent magnet interposed between said pole ends;

an armature block having an elongated generally flat armature and a set of movable springs carrying movable contacts and held together with said armature by means of an electrically insulating harness molded on said armature, said armature pivotally supported on said coil block by hinge springs to be movable between two contact operating positions and constituting a magnetic circuit with said core and said permanent magnet for polarized operation of said armature, said hinge springs being disposed on lateral sides of said armature at a longitudinal center of said armature, each of said hinge springs integrally formed with a beam projecting from said harness and with an anchor tab extending integrally from said beam and secured to a corresponding projection of said coil block, said harness formed integrally with a side post which projects on the lateral side of said armature and from which said beam extends over a limited length along the lateral side of said armature; and a terminal assembly including coil terminals leading to said coil means and fixed contact terminals provided respectively with fixed contacts at contact ends of said contact terminals;

said polarized relay characterized in that said coil block and said terminal assembly are molded together from an electrically insulating material into a single integral base unit on which said armature block is assembled with said movable contacts held in an engageable relation with said fixed contacts;

wherein said side post from which said beam extends is offset toward one longitudinal end of said armature from a longitudinal center thereof at which said armature is pivotally supported.

8. A polarized relay as set forth in claim 7, wherein said armature is biased by said magnetic circuit to give a mono-stable operation such that one longitudinal end of said armature is defined as a normally closed end and the other end is defined as a normally open end, and said side post from which said beam extends being offset toward said normally open end of said armature.

9. A polarized relay comprising:

a coil block having an elongated coil bobbin, a core inserted therein, and excitation coil means wound about said coil bobbin, said core having opposed pole ends projecting upwardly from longitudinal ends of said coil bobbin, said coil block including a permanent magnet interposed between said pole ends;

an armature block having an elongated generally flat armature and a set of movable springs carrying movable contacts and held together with said armature by means of an electrically insulating harness molded on said armature, said armature pivotally supported on said coil block by hinge springs to be movable between two contact operating positions and constituting a magnetic circuit with said core and said permanent magnet for polarized operation of said armature, said hinge springs being disposed on lateral sides of said armature at a longitudinal center of said armature, each of said hinge springs integrally formed with a beam projecting from said harness and with an anchor tab extending integrally from said beam and secured to a corresponding projection of said coil block, said harness formed integrally with a side post which projects on the lateral side of said armature and from which said beam extends over a limited length along the lateral side of said armature; and a terminal assembly including coil terminals leading to said coil means and fixed contact terminals provided respectively with fixed contacts at contact ends of said contact terminals;

said polarized relay characterized in that said coil block and said terminal assembly are molded together from an electrically insulating material into a single integral base unit on which said armature block is assembled with said movable contacts held in an engageable relation with said fixed contacts;

wherein said beam and said anchor tab lie substantially in the same plane and are integrally connected by means of a U-shaped segment which is bent in a direction perpendicular to said plane.

10. A polarized relay as set forth in claim 6, wherein said anchor tab extends in parallel relation in such a manner as to give a generally U-shaped configuration to said hinge spring, said beam being formed along its length with a bent.

11. A method of making a polarized relay, comprising:

providing a coil block having an elongated coil bobbin, a core inserted therein, and excitation coil means wound about said coil bobbin, said bobbin being formed integrally on its upper end with supports, said core having opposed pole ends projecting upwardly from longitudinal ends of said coil bobbin, said coil block including a permanent magnet interposed between said pole ends;

providing an armature block having an elongated generally flat armature and a set of movable springs carrying movable contacts and held together with said armature by means of an electrically insulating harness molded on said armature, said armature pivotally supported on said coil block to be movable between two contact operating positions and constituting a magnetic circuit with said core and said permanent magnet for polarized operation of said armature;

providing a terminal assembly including coil terminals for attachment to said coil means and fixed contact terminals provided respectively with fixed contacts at contact ends of said contact terminals;

disposing said coil block and said terminal assembly in a mold having an upper molding die and a lower molding die so that said coil terminals lead to said coil means and so that said supports hold said contact ends against said upper molding die;

molding said coil block and said terminal assembly together by introducing an electrically insulating material into said mold to mold said coil block and said terminal assembly together into a single integral base unit; and assembling said armature block onto said integral base unit with said movable contacts held in an engageable relation with said fixed contacts.

12. A method of making a polarized relay as set forth in claim 11, wherein said supports are in the form of integral projections on said coil bobbin.

13. A method of making a polarized relay as set forth in claim 11, wherein said coil bobbin is formed integrally on its lower end with collapsible bumps which are adapted to abut against said lower molding die when molding said coil block into said base unit in order to urge said supports upwardly for pressing said contact ends against said upper molding die.

14. A method of making a polarized relay as set forth in claim 12, wherein said coil bobbin is formed integrally on its lower end with collapsible bumps which are adapted to abut against said lower molding die when molding said coil block into said base unit in order to urge said supports upwardly for pressing said contact ends against said upper molding die.

15. A method of making a polarized relay as set forth in claim 11, wherein said coil terminals are formed with patches which are welded to corresponding leads integrally molded in said coil bobbin at portions spaced generally vertically below associated ones of said fixed contacts.

16. A method of making a polarized relay as set forth in claim 15, wherein said coil assembly is in the form of a blank from which said coil terminals and fixed contact terminals are stamped to extend in adjacent relation, each of said coil terminals spaced vertically downwardly of the adjacent one of said fixed contacts and connected integrally thereto by means of a bent segment at which said coil terminal is to be separated from said fixed contact terminal.

* * * * *